US008659346B2

(12) United States Patent
Ogawa

(10) Patent No.: US 8,659,346 B2
(45) Date of Patent: Feb. 25, 2014

(54) BODY-BIAS VOLTAGE CONTROLLER AND METHOD OF CONTROLLING BODY-BIAS VOLTAGE

(75) Inventor: Yasushige Ogawa, Kasugai (JP)

(73) Assignee: Spansion LLC, Sunnyvale, CA (US)

( * ) Notice: Subject to any disclaimer, the term of this patent is extended or adjusted under 35 U.S.C. 154(b) by 0 days.

(21) Appl. No.: 12/835,732

(22) Filed: Jul. 13, 2010

(65) Prior Publication Data

US 2011/0012672 A1 Jan. 20, 2011

(30) Foreign Application Priority Data

Jul. 15, 2009 (JP) ..... 2009-166296

(51) Int. Cl.
*G05F 1/10* (2006.01)

(52) U.S. Cl.
USPC ..... 327/535; 327/534; 327/537

(58) Field of Classification Search
USPC ..... 327/534, 535, 537
See application file for complete search history.

(56) References Cited

U.S. PATENT DOCUMENTS 4,584,662 A * 4/1986 Lin ..... 703/4
5,682,118 A * 10/1997 Kaenel et al. ..... 327/534
5,834,967 A * 11/1998 Kuroda et al. ..... 327/543
6,043,638 A 3/2000 Tobita
6,087,892 A * 7/2000 Burr ..... 327/534
6,304,110 B1 * 10/2001 Hirano ..... 327/108
6,313,691 B1 * 11/2001 Podlesny et al. ..... 327/534
6,353,357 B1 * 3/2002 Kaiser et al. ..... 327/537
6,466,077 B1 * 10/2002 Miyazaki et al. ..... 327/534
6,590,804 B1 * 7/2003 Perner ..... 365/158
6,759,878 B2 * 7/2004 Fujita ..... 327/66
6,864,539 B2 * 3/2005 Ishibashi et al. ..... 257/368
6,917,237 B1 * 7/2005 Tschanz et al. ..... 327/513
7,030,637 B2 * 4/2006 Berthold et al. ..... 324/750.3
7,095,269 B2 * 8/2006 Yamada ..... 327/537
7,109,782 B2 * 9/2006 Kase ..... 327/534
7,425,861 B2 * 9/2008 Egerer et al. ..... 327/534
7,492,215 B2 * 2/2009 Lee et al. ..... 327/544
7,498,863 B2 * 3/2009 Denais et al. ..... 327/427
7,501,880 B2 * 3/2009 Bonaccio et al. ..... 327/534
7,504,876 B1 * 3/2009 Raghavan et al. ..... 327/536
7,564,296 B2 * 7/2009 Ito ..... 327/534
7,598,796 B2 * 10/2009 Mizuno et al. ..... 327/536
7,659,769 B2 * 2/2010 Nakaya et al. ..... 327/534

(Continued)

FOREIGN PATENT DOCUMENTS

JP 7-176622 A 7/1995
JP 2000-155620 6/2000

(Continued)

OTHER PUBLICATIONS

Japanese Office Action mailed Aug. 20, 2013 for related Japanese Patent Application No. 2009-166296, filed Jul. 15, 2009; 3 pages.

*Primary Examiner* — Thomas J Hiltunen
(74) *Attorney, Agent, or Firm* — Sterne, Kessler, Goldstein & Fox P.L.L.C.

(57) ABSTRACT

A body-bias voltage controller includes: a plurality of transistors at least one of which is supplied with a body-bias voltage; a monitor circuit to detect voltage characteristics of the plurality of transistors and to output a indicator signal; and a body-bias voltage generator to generate the body-bias voltage based upon the indicator signal.

11 Claims, 10 Drawing Sheets

(56) References Cited

U.S. PATENT DOCUMENTS

| | | | | |
|---|---|---|---|---|
| 7,786,756 | B1 * | 8/2010 | Svilan et al. | 326/33 |
| 2001/0052623 | A1 * | 12/2001 | Kameyama et al. | 257/369 |
| 2004/0046602 | A1 * | 3/2004 | Yamada | 327/535 |
| 2006/0038605 | A1 | 2/2006 | De Gyvez et al. | |
| 2006/0091936 | A1 * | 5/2006 | Ikenaga et al. | 327/534 |
| 2006/0226464 | A1 * | 10/2006 | Gatta | 257/303 |
| 2007/0024342 | A1 * | 2/2007 | Sumita et al. | 327/534 |
| 2007/0085596 | A1 | 4/2007 | Ito | |
| 2009/0289696 | A1 * | 11/2009 | Lewis et al. | 327/534 |
| 2010/0164607 | A1 * | 7/2010 | Miyatake et al. | 327/537 |

FOREIGN PATENT DOCUMENTS

| | | | |
|---|---|---|---|
| JP | 2000-163970 | A | 6/2000 |
| JP | 2005-536105 | | 11/2005 |
| JP | 2006-129392 | | 5/2006 |
| JP | 3868131 | B2 | 1/2007 |
| JP | 2007-135185 | | 5/2007 |

* cited by examiner

BODY-BIAS VOLTAGE CONTROLLER AND METHOD OF CONTROLLING BODY-BIAS VOLTAGE

CROSS-REFERENCE TO RELATED APPLICATIONS

This application claims the benefit of priority from Japanese Patent Application No. 2009-166296 filed on Jul. 15, 2009, the entire contents of which are incorporated herein by reference.

BACKGROUND

1. Field

The embodiments discussed herein relate to a body-bias voltage controller and method of controlling body-bias voltage.

2. Description of Related Art

In order to correct a threshold voltage of a transistor formed on a semiconductor substrate, a body-bias voltage is supplied to the semiconductor substrate. The body-bias voltage is adjusted using a change in a resistance value of a fuse element when the fuse element is cut. When the body-bias voltage is adjusted by cutting a fuse element, a manufacturing process, such as, laser trimming process, may be added.

SUMMARY

According to one aspect of the embodiments, a body-bias voltage controller includes: a plurality of transistors at least one of which is supplied with a body-bias voltage; a monitor circuit to detect voltage characteristics of the plurality of transistors and to output a indicator signal; and a body-bias voltage generator to generate the body-bias voltage based upon the indicator signal.

Additional advantages and novel features of the invention will be set forth in part in the description that follows, and in part will become more apparent to those skilled in the art upon examination of the following or upon learning by practice of the invention.

DESCRIPTION OF EMBODIMENTS

Figure 1:
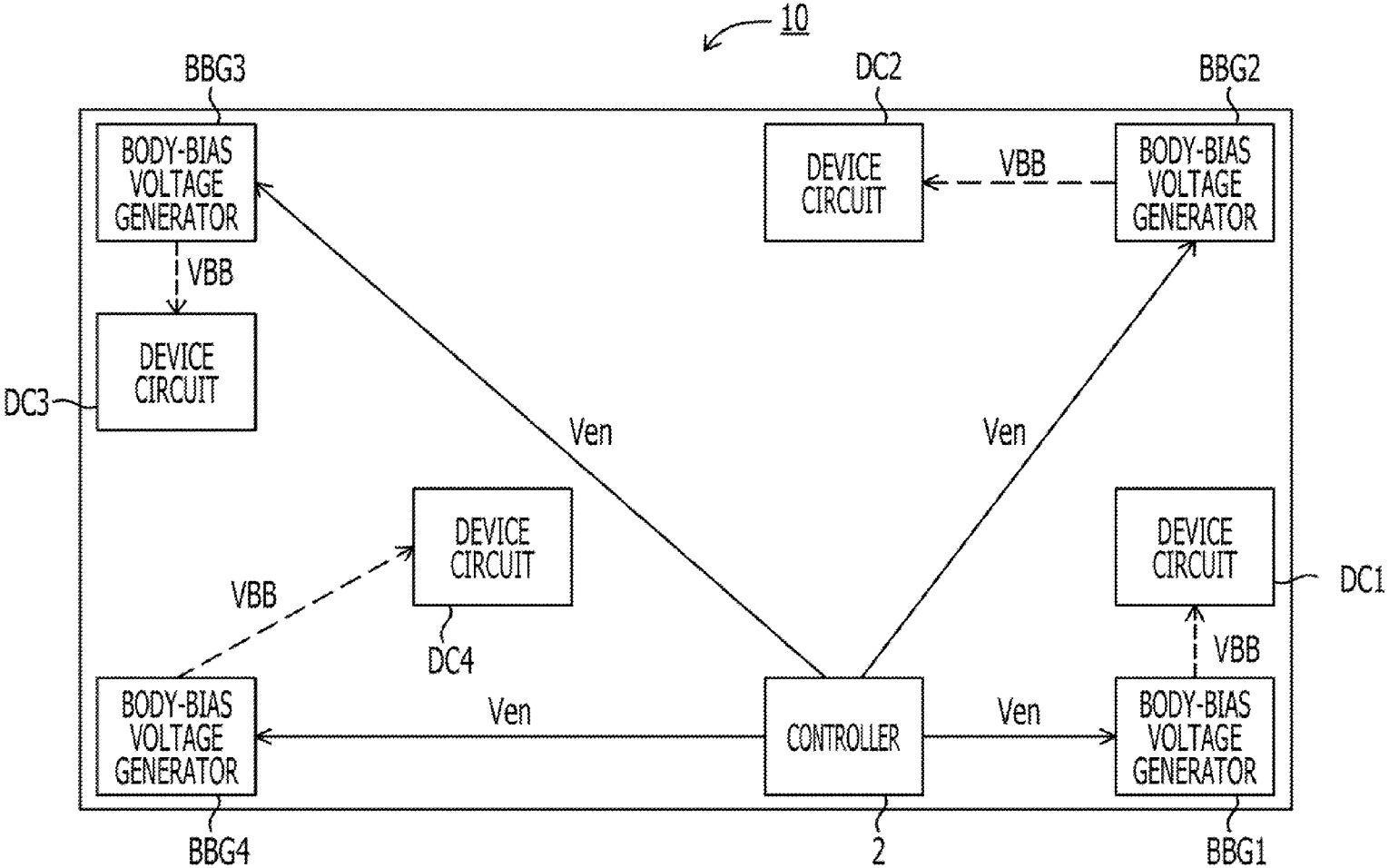
FIG. 1 illustrates an exemplary semiconductor device.

FIG. 1 illustrates a exemplary semiconductor device. In the semiconductor device 10, threshold voltages of the other transistors may come close to a threshold voltage of a reference transistor. The semiconductor device 10 includes a controller 2, a body-bias voltage generator BBG1, a body-bias voltage generator BBG2, a body-bias voltage generator BBG3, a body-bias voltage generator BBG4, a device circuit DC1, a device circuit DC2, a device circuit DC3, and a device circuit DC4. The controller 2 supplies a control signal Ven to each of the body-bias voltage generators BBG1 to BBG4. The body-bias voltage generators BBG1 to BBG4 generate a body-bias voltage VBB in response to the control signals Ven, and supply the voltage to the device circuits DC1 to DC4, respectively. The device circuits DC1 to DC4 may perform various operations, and include a plurality of MOS transistors. The body-bias voltage VBB is supplied to backgates of the MOS transistors included in the device circuits DC1 to DC4.

The body-bias voltage generators BBG1 to BBG4 include high-voltage wiring lines and charge pumps, individually. The body-bias voltage generators BBG1 to BBG4 may become noise sources, and may be disposed on the periphery of the semiconductor device 10. In order to supply the body-bias voltage VBB substantially equally to each of the device circuits DC1 to DC4, the body-bias voltage generators BBG1 to BBG4 may be substantially evenly laid out in the semiconductor device 10. The body-bias voltage generators BBG1 to BBG4 may be disposed such that delays of the digital control signals Ven output from the controller 2 to the body-bias voltage generators BBG1 to BBG4 become substantially equal. The wiring lines individually coupling the controller 2 to the body-bias voltage generators BBG1 to BBG4 may have a length substantially equal to one another.

Figure 2:
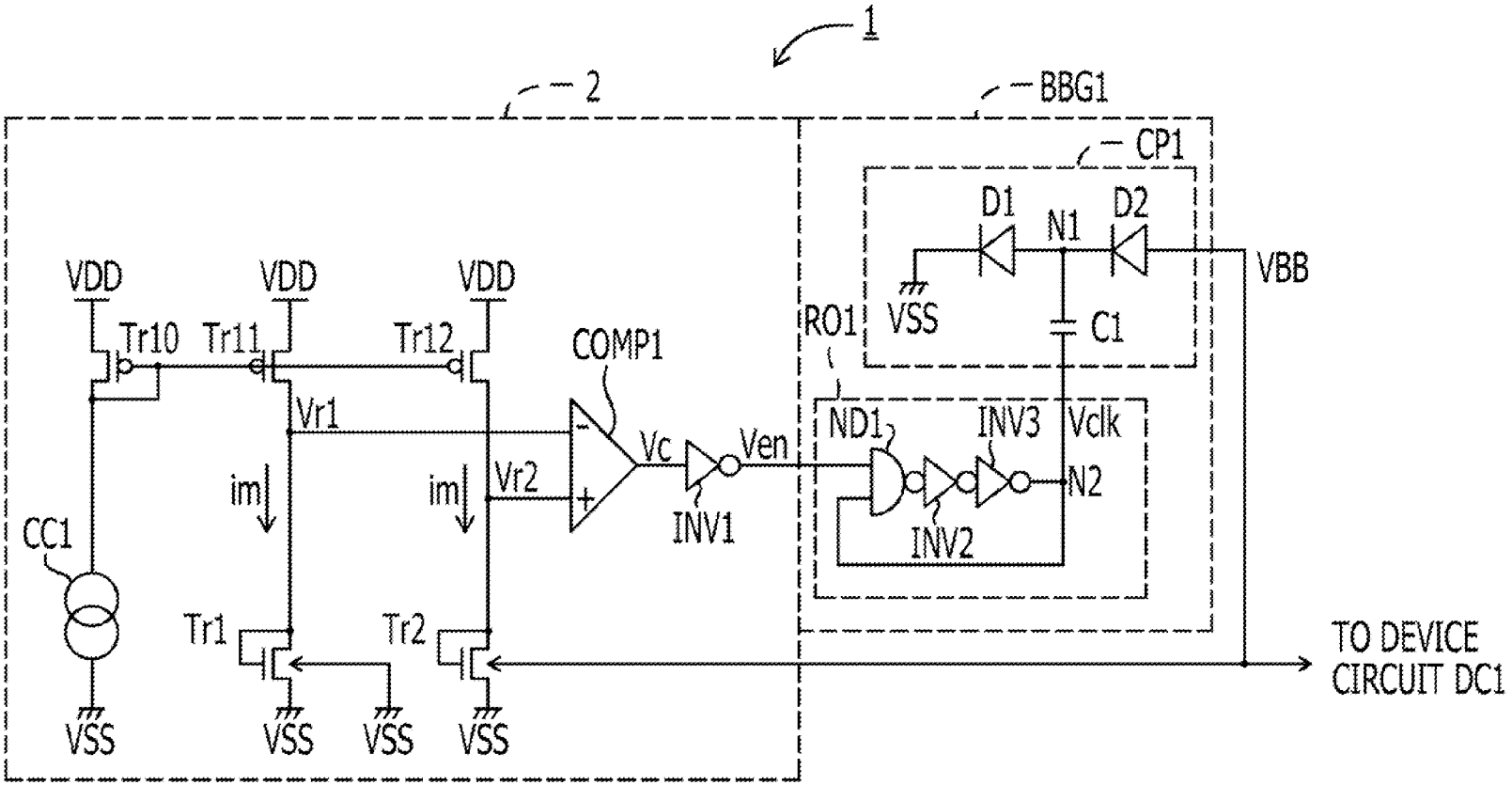
FIG. 2 illustrates an exemplary biasing circuit.

FIG. 2 illustrates an exemplary biasing circuit. The biasing circuit illustrated in FIG. 2 may be applied to the semiconductor device 10 of FIG. 1. The biasing circuit 1 may include the controller 2 of FIG. 1 and the body-bias voltage generator BBG1 of FIG. 1. The controller 2 includes an NMOS transistor Tr1, an NMOS transistor Tr2, a comparator COMP1, an inverter INV1, a constant current circuit CC1, a PMOS transistor Tr10, a PMOS transistor Tr11, and a PMOS transistor Tr12.

As further illustrated in FIG. 2, the controller 2 includes the NMOS transistor Tr1 and the NMOS transistor Tr2. The device circuit DC1 of FIG. 1 includes a plurality number of transistors. The plurality number of transistors may have variations in threshold voltage. Variations in threshold voltage may occur when manufacturing variations occur in the process of manufacturing semiconductor devices or when designing a circuit in which transistors have different voltages. If there are variations in threshold voltage of transistors, variations in switching speed and power consumption among the transistors may occur. Thus, it can be beneficial to reduce variations in threshold voltage of the transistors. In the biasing circuit 1, the amount of variations in threshold voltage of transistors is monitored by the NMOS transistor Tr1 and the NMOS transistor Tr2.

As illustrated in FIG. 2, a ground voltage VSS is supplied to the source terminal and the backgate terminal of the NMOS transistor Tr1. The gate terminal and the drain terminal of the NMOS transistor Tr1 are diode-coupled. The ground voltage VSS is supplied to the source terminal of the NMOS transistor Tr2. The body-bias voltage VBB is supplied to the backgate terminal of the NMOS transistor Tr2. The gate terminal and the drain terminal of the NMOS transistor Tr2 are diode-coupled.

The NMOS transistor Tr1 is a replica transistor having a threshold voltage in the vicinity of an upper limit value of the amount of variations in the threshold voltage of the transistors in the device circuit DC1. A threshold voltage Vth1 of the NMOS transistor Tr1 is used as a reference voltage. Also, the NMOS transistor Tr2 is a replica transistor having a threshold voltage in the vicinity of a lower limit value of the amount of variations in the threshold voltage of the transistors in the device circuit DC1. A threshold voltage Vth2 of the NMOS transistor Tr2 may be raised for body-bias effect by controlling the body-bias voltage VBB. A value of the body-bias voltage VBB when the threshold voltage Vth2 is substantially equal to the threshold voltage Vth1 may be determined. The obtained body-bias voltage VBB is supplied to the device circuit DC1, thereby reducing variations in the switching speed and the power consumption among the transistors in the device circuit DC1 of FIG. 1.

As further illustrated in FIG. 2, a current-mirror circuit includes a PMOS transistor Tr10, a PMOS transistor Tr11, and a PMOS transistor Tr12. Gate terminals of the PMOS transistor Tr10, the PMOS transistor Tr11, and the PMOS transistor Tr12 are coupled to each other, and a power-source voltage VDD is supplied to source terminals of the PMOS transistor Tr10, the PMOS transistor Tr11, and the PMOS transistor Tr12. The constant current circuit CC1 is coupled to the drain terminal of the PMOS transistor Tr10. The NMOS transistor Tr1 is coupled to the drain terminal of the PMOS transistor Tr11. The NMOS transistor Tr2 is coupled to the drain terminal of the PMOS transistor Tr12. A current generated by the constant current circuit CC1 is input into the PMOS transistor Tr10. The mirrored current inn is output from the drain terminals of the PMOS transistor Tr11 and the PMOS transistor Tr12, and flows into the NMOS transistor Tr1 and the NMOS transistor Tr2.

As further illustrated in FIG. 2, the drain terminal of the NMOS transistor Tr1 is coupled to an inverted input terminal of the comparator COMP1, and a voltage Vr1 is input into the terminal. The voltage Vr1 is a voltage that changes in accordance with the threshold voltage Vth1 of the NMOS transistor Tr1. The higher the threshold voltage Vth1 is, the higher the voltage Vr1 becomes. The drain terminal of the NMOS transistor Tr2 is coupled to a non-inverted input terminal of the comparator COMP1, and a voltage Vr2 is input into the terminal. The voltage Vr2 may be a voltage that changes in accordance with the threshold voltage Vth2 of the NMOS transistor Tr2. The higher the threshold voltage Vth2 is, the higher the voltage Vr2 becomes. The comparator COMP1 outputs a signal Vc in accordance with a difference voltage between the threshold voltage Vth1 of the NMOS transistor Tr1 and the threshold voltage Vth2 of the NMOS transistor Tr2. The signal Vc is inverted by the inverter INV1. The output of the inverter INV1 is supplied as the control signals Ven to the body-bias voltage generators BBG1 to BBG4 of FIG. 1.

As further illustrated in FIG. 2, the body-bias voltage generator BBG1 includes a ring oscillator RO1 and a charge pump CP1. The ring oscillator RO1 includes a NAND circuit ND1, inverters INV2 and INV3. The inverter INV2 and the inverter INV3 are coupled in series to the output terminal of the NAND circuit ND1. The output terminal of the inverter INV3 is coupled to one of the input terminals of the NAND circuit ND1. The control signal Ven is input into the other of the input terminals of the NAND circuit ND1. An oscillation signal Vclk is output from the output terminal of the inverter INV3. The oscillation signal Vclk is input into a capacitor C1 of the charge pump CP1.

As further illustrated in FIG. 2, in a period of the control signal Ven at a high level, the NAND circuit ND1 may operate as an inverter which inverts a signal looped back from the inverter INV3 and outputs the resultant signal. In the period of the control signal Ven at the high level, the ring oscillator RO1 alternately outputs the output signal having a high level and the output signal having a low level, and may perform oscillation operation. In a period of the control signal Ven at a low level, the NAND circuit ND1 maintains the output signal at the high level. In the period of the control signal Ven at the low level, the ring oscillator RO1 may stop the oscillation operation.

As further illustrated in FIG. 2, the charge pump CP1 includes the capacitor C1, a diode D1, and a diode D2. The ground voltage VSS is supplied to the cathode of the diode D1. The anode of the diode D1 and the cathode of the diode D2 are coupled to a node (pumping node) N1. One end of the capacitor C1 is coupled to the node N1. The other end of the capacitor C1 is coupled to a node (output terminal of the ring oscillator RO1) N2. The body-bias voltage VBB is output from the anode of the diode D2. The body-bias voltage generator BBG2 of FIG. 1, the body-bias voltage generator BBG3 of FIG. 1, and the body-bias voltage generator BBG4 of FIG. 1 may have substantially the same configuration as or similar configuration to that of the body-bias voltage generator BBG1.

Figure 3:
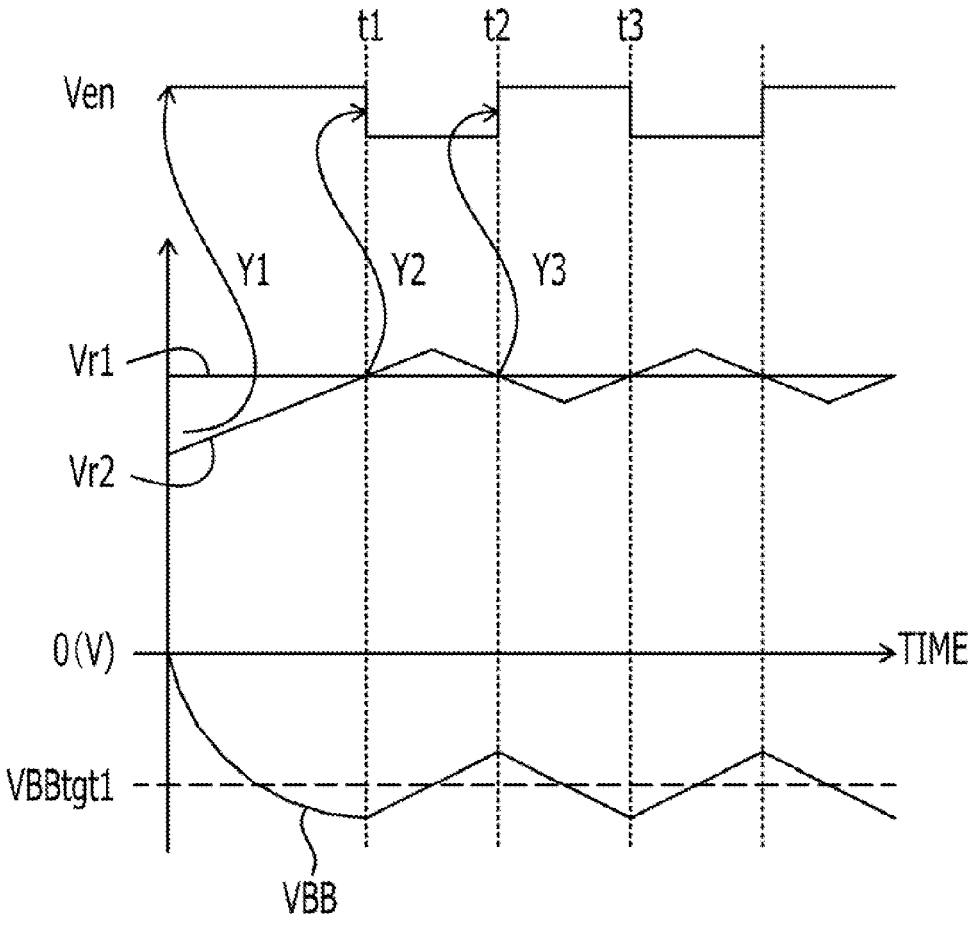
FIG. 3 illustrates an exemplary timing chart.

FIG. 3 illustrates an exemplary timing chart. The timing chart illustrated in FIG. 3 may be a timing chart of the biasing circuit 1 of FIG. 2 when the ground voltage VSS of FIG. 2 is 0 (V). In the timing chart, the voltage amplitude value of the oscillation signal Vclk of FIG. 2 may be between the power-source voltage VDD of FIG. 2 and the ground voltage VSS of FIG. 2.

As illustrated in FIG. 3, at time t1, the semiconductor device 10 of FIG. 1 starts operation, and the biasing circuit 1 of FIG. 2 starts operation. At time t1, the body-bias voltage VBB of FIG. 2 may be 0 (V), and body-bias effect is not obtained, and thus the value of the threshold voltage Vth2 of the NMOS transistor Tr2 of FIG. 2 may be an initial setting value. Since the initial setting value of the threshold voltage Vth2 is set lower than the threshold voltage Vth1 of the NMOS transistor Tr1 of FIG. 2, the voltage Vr2 becomes lower than the voltage Vr1. The signal Vc of FIG. 2 output from the comparator COMP1 of FIG. 2 becomes a low level, and the control signal Ven becomes a high level (Y1).

As further illustrated in FIG. 3, when the control signal Ven having a high level is input into the body-bias voltage generator BBG1 of FIG. 2, the ring oscillator RO1 of FIG. 2 starts oscillation operation. When the ring oscillator RO1 of FIG. 2 oscillates, the charge pump CP1 of FIG. 2 starts operation. For the sake of simplification, an exemplary case will be given where a voltage drop by the diode D1 of FIG. 2 and the diode D2 of FIG. 2 may be 0 (V). With the oscillation signal Vclk of FIG. 2 at a high level, the node N2 of the capacitor C1 of FIG. 2 may have the power-source voltage VDD, and the node N1 may have the ground voltage VSS. A potential difference of the power-source voltage VDD is applied across the capacitor C1 of FIG. 2. When the oscillation signal Vclk of FIG. 2 changes to a low level, the potential of the node N2 of the capacitor C1 of FIG. 2 drops from the power-source voltage VDD to the ground voltage VSS, for example, drops by the power-source voltage VDD. The potential difference across the capacitor C1 of FIG. 2 may be held, and thus the potential of the node N1 may drop to −VDD. When the potential of the node N1 of the capacitor C1 of FIG. 2 drops to −VDD, the diode D2 of FIG. 2 is in a conductive state, and thus a negative potential is output at the output terminal of the charge pump CP1 of FIG. 2. The oscillation signal Vclk of FIG. 2 periodically becomes a high level and a low level, and thereby the body-bias voltage VBB gradually decreases to a negative value.

When the body-bias voltage VBB gradually decreases to a negative value, in the NMOS transistor Tr2 of FIG. 2, the gate-to-backgate voltage becomes greater than the gate-to-source voltage. By body-bias effect in accordance with the decrease of the body-bias voltage VBB, the threshold voltage Vth2 of the NMOS transistor Tr2 of FIG. 2 may be raised. The voltage Vr2 may be raised in accordance with the increase of the threshold voltage Vth2.

As further illustrated in FIG. 3, at time t2, when the threshold voltage Vth2 of the NMOS transistor Tr2 of FIG. 2 becomes higher than the threshold voltage Vth1 of the NMOS transistor Tr1 of FIG. 2, the output voltage of the comparator COMP1 of FIG. 2 changes to a high level, and the control signal Ven changes to a low level (Y2). Upon the control signal Ven at the low level being input into the body-bias voltage generator BBG1 of FIG. 2, the ring oscillator RO1 of FIG. 2 may stop oscillation operation, and the operation of the charge pump CP1 may stop. When the threshold voltage Vth2 becomes higher than the threshold voltage Vth1, the body-bias voltage generator BBG1 of FIG. 2 may stop operation.

When the body-bias voltage generator BBG1 of FIG. 2 stops operation, the body-bias voltage VBB gradually increases. In response to an increase in the body-bias voltage VBB, the threshold voltage Vth2 of the NMOS transistor Tr2 of FIG. 2 gradually decreases by body-bias effect. The voltage Vr2 drops in accordance with a decrease of the threshold voltage Vth2.

As further illustrated in FIG. 3, at time t3, when the threshold voltage Vth2 of the NMOS transistor Tr2 of FIG. 2 becomes lower than the threshold voltage Vth1 of the NMOS transistor Tr1 of FIG. 2, the output voltage of the comparator COMP1 of FIG. 2 changes to a low level, and the control signal Ven changes to a high level (Y3). Upon the control signal Ven having the high level being input into the body-bias voltage generator BBG1 of FIG. 2, the ring oscillator RO1 of FIG. 2 starts oscillation operation, and the operation of the charge pump CP1 starts. When the threshold voltage Vth2 becomes lower than the threshold voltage Vth1, the body-bias voltage generator BBG1 of FIG. 2 starts operation.

When the body-bias voltage generator BBG1 of FIG. 2 starts operation, the body-bias voltage VBB gradually decreases. In response to a decrease in the body-bias voltage VBB, the threshold voltage Vth2 of the NMOS transistor Tr2 of FIG. 2 gradually increases by body-bias effect. The voltage Vr2 is raised in accordance with an increase of the threshold voltage Vth2.

As further illustrated in FIG. 3, when the threshold voltage Vth2 becomes higher than the threshold voltage Vth1, the body-bias voltage generator BBG1 of FIG. 2 may stop operation. When the threshold voltage Vth2 becomes lower than the threshold voltage Vth1, the body-bias voltage generator BBG1 of FIG. 2 may start operation. The body-bias voltage generator BBG1 of FIG. 2 repeats the start and stop of the operation, and the body-bias voltage VBB is held as an average value to be a target body-bias voltage VBBtgt1 in order to make the threshold voltage Vth2 substantially equal to the threshold voltage Vth1. The operations of the body-bias voltage generator BBG2, the body-bias voltage generator BBG3 and the body-bias voltage generator BBG4, which are illustrated in FIG. 1, may be substantially the same as or similar to the operation of the body-bias voltage generator BBG1 of FIG. 2.

The body-bias voltage VBB held as the average value to be the target body-bias voltage VBBtgt1 is supplied to the backgate terminal of the transistor included in the device circuit DC1 of FIG. 1.

Figure 4:
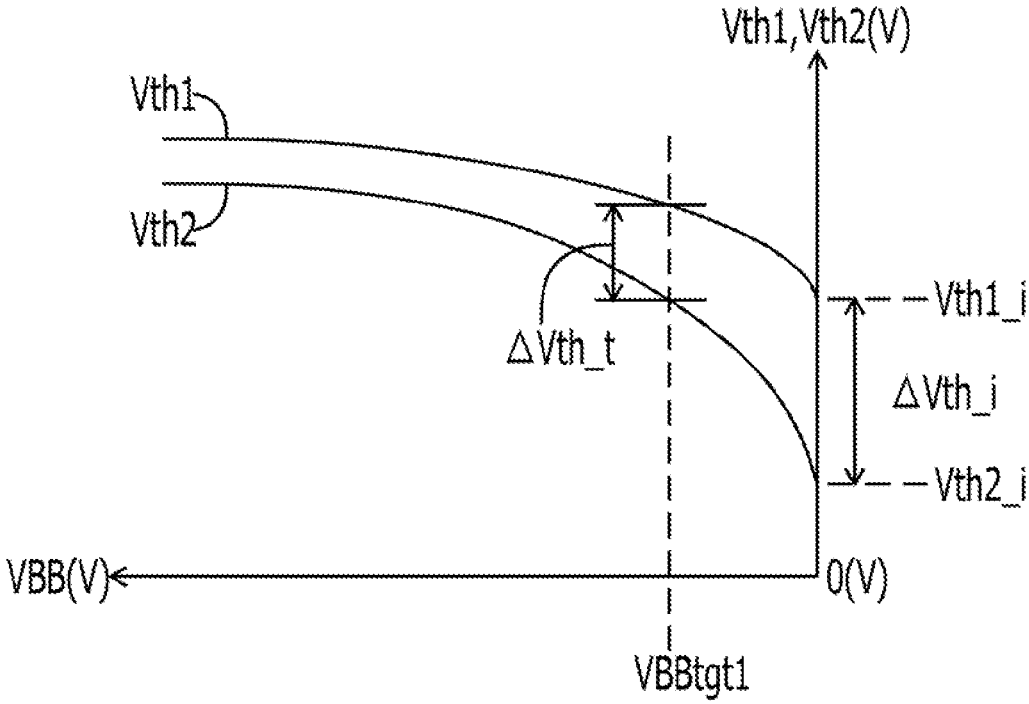
FIG. 4 illustrates an exemplary body-bias voltage characteristic.

FIG. 4 illustrates an exemplary body-bias voltage characteristic. The body-bias voltage characteristic illustrated in FIG. 4 may be a body-bias voltage characteristic of the biasing circuit 1 of FIG. 2. In the biasing circuit 1 of FIG. 2, an initial threshold voltage Vth1_i of the NMOS transistor Tr1 may be higher than an initial threshold voltage Vth2_i of the NMOS transistor Tr2. When body-bias voltage VBB drops to a negative value, the threshold voltages Vth1 and Vth2 may be raised by body-bias effect. The ratio of increase in the threshold voltage Vth2 of the NMOS transistor Tr2 having the initial threshold voltage Vth2_i, which is lower than the initial threshold voltage Vth1_i, may be higher than the ratio of increase in the threshold voltage Vth1 of the NMOS transistor Tr1. By supplying the target body-bias voltage VBBtgt1, the value of difference between the threshold voltages Vth1 and Vth2 may be reduced from a difference voltage ΔVth_i to a difference voltage ΔVth_t.

Figure 5:
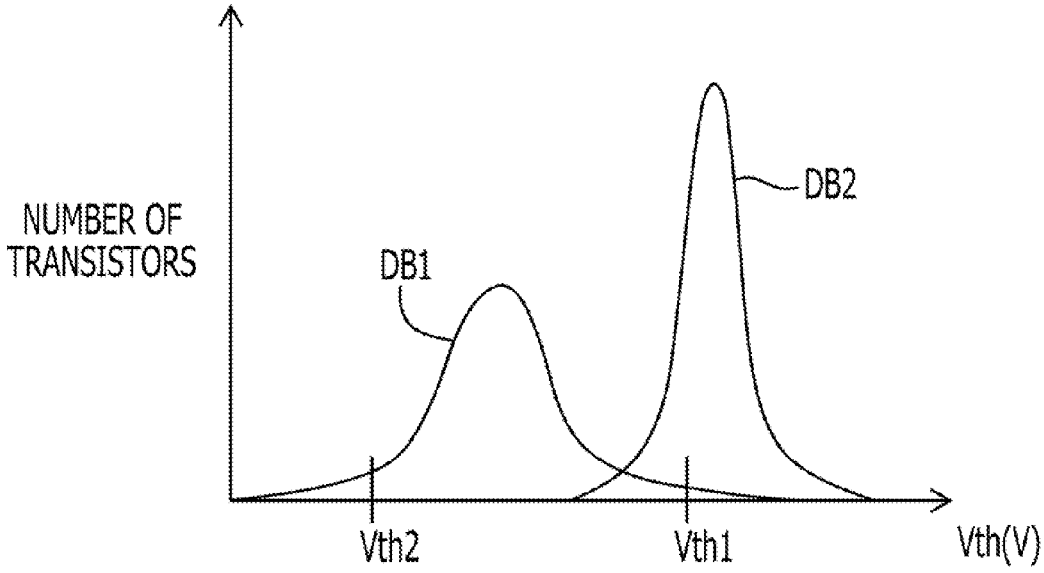
FIG. 5 illustrates exemplary variation distributions of threshold voltages.

FIG. 5 illustrates exemplary variation distributions. The variation distributions may be variation distribution of the threshold voltages of the transistors included in the device circuit DC1 of FIG. 1. The distribution curve DB1 having a wide bottom and a low peak indicates the variation distribution of the threshold voltage of the transistors when the target body-bias voltage VBBtgt1 of FIG. 4 is not supplied to the device circuit DC1 of FIG. 1. If the target body-bias voltage VBBtgt1 of FIG. 4 is not supplied, variations in the threshold voltage of the transistors may be large. The distribution curve DB2 having a narrow bottom and a high peak indicates the variation distribution of the threshold voltage of the transistors when the target body-bias voltage VBBtgt1 of FIG. 4 is supplied to the device circuit DC1 of FIG. 1. If the target body-bias voltage VBBtgt1 of FIG. 4 is supplied, the value of difference in the threshold voltages of the transistors may be reduced, and thus variations in the threshold voltage of the transistors may be small. When the target body-bias voltage VBBtgt1 of FIG. 4 is supplied, variations in switching speed and power consumption among the transistors included in the device circuit DC1 of FIG. 1 may be reduced.

According to the biasing circuit 1 of FIG. 2, the difference voltage between the threshold voltage Vth1 of the NMOS transistor Tr1 and the threshold voltage Vth2 of the NMOS transistor Tr2 may be detected. The value of the body-bias voltage VBB is controlled such that the threshold voltage Vth2 may come close to the threshold voltage Vth1. The biasing circuit 1 includes a feedback loop to adjust the threshold voltage Vth2 of the NMOS transistor Tr2. The feedback loop is used to control and reduce variations in the threshold voltage of transistors.

According to the biasing circuit 1 of FIG. 2, the threshold voltage Vth1 of the NMOS transistor Tr1 is used as a reference voltage, and the body-bias voltage VBB may be controlled in accordance with the actual use, thereby the control of the body-bias voltage VBB being improved.

Figure 6:
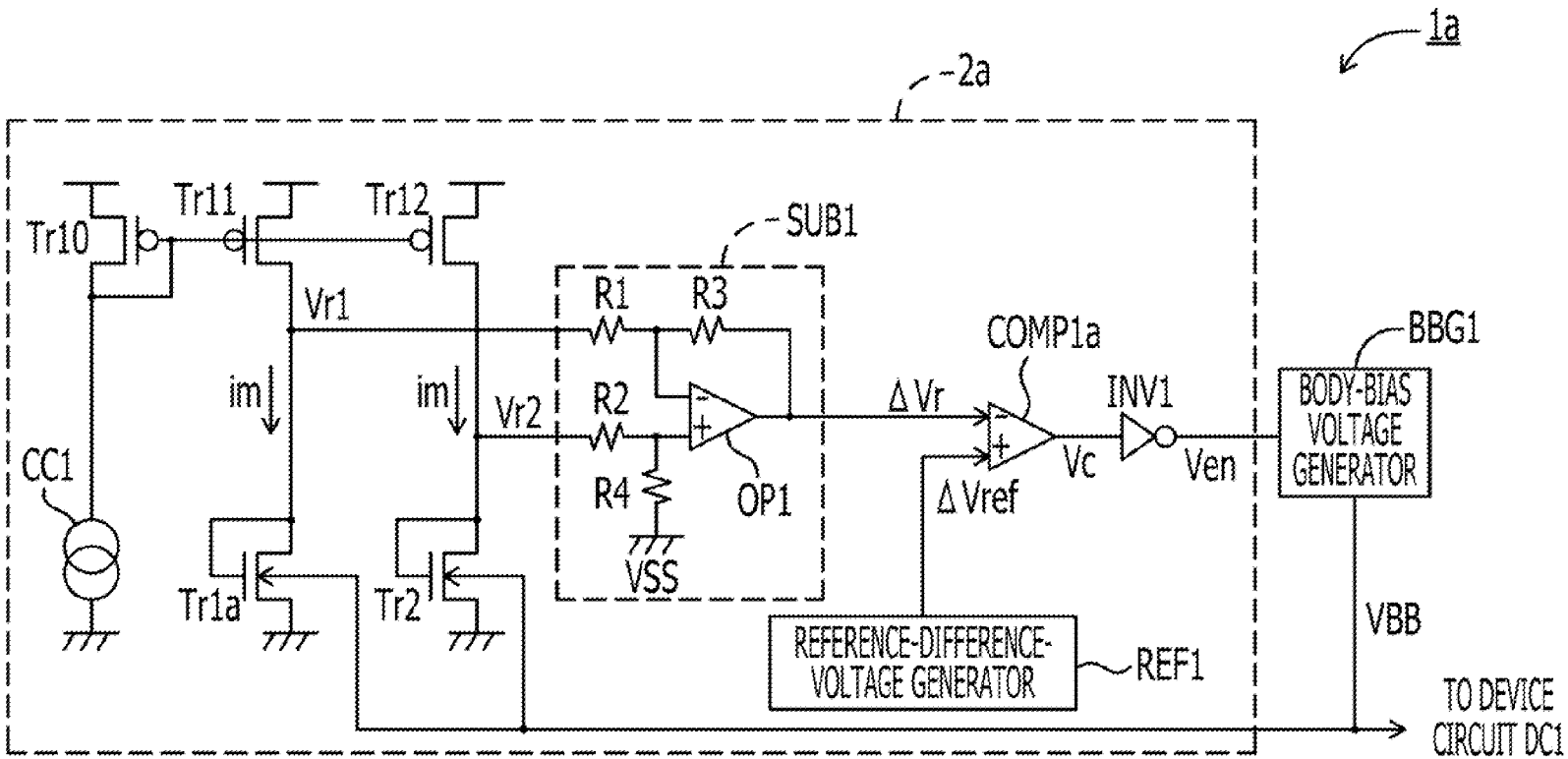
FIG. 6 illustrates an exemplary biasing circuit.

FIG. 6 illustrates an exemplary biasing circuit. The biasing circuit illustrated 1*a* in FIG. 6 may be applied to the semiconductor device 10 of FIG. 1. The biasing circuit 1*a* includes a controller 2*a* and a body-bias voltage generator BBG1. The controller 2*a* includes an NMOS transistor Tr1*a*, an NMOS transistor Tr2, a subtracter SUB1, a reference-differential-voltage generator REF1, a comparator COMP1*a*, an inverter INV1, a constant current circuit CC1, a PMOS transistor Tr10, a PMOS transistor Tr11, and a PMOS transistor Tr12.

As illustrated in FIG. 6, the ground voltage VSS is supplied to the source terminal of the NMOS transistor Tr1*a* and the source terminal of the NMOS transistor Tr2. The body-bias voltage VBB is supplied to the backgate terminal of the NMOS transistor Tr1*a* and the backgate terminal of the NMOSTr2. The threshold voltage Vth1 of the NMOS transistor Tr1*a* and the threshold voltage Vth2 of the NMOS transistor Tr2 may be raised by body-bias effect obtained by controlling the body-bias voltage VBB.

When the body-bias voltage VBB is set to 0 (V) and body-bias effect is not obtained, the threshold voltage of the NMOS transistor Tr1*a* may be defined as an initial threshold voltage Vth1_i, and the threshold voltage of the transistor Tr2 may be defined as an initial threshold voltage Vth2_i. For example, the initial threshold voltage Vth2_i of the NMOS transistor Tr2 may be lower than the initial threshold voltage Vth1_i of the NMOS transistor Tr1*a*. The initial threshold voltage Vth1_i, which is higher than the initial threshold voltage Vth2_i, may be set by providing the transistors having different gate lengths and gate widths. For example, the gate length of the NMOS transistor Tr1*a* may be L1, the gate width thereof may be W1, the gate length of the NMOS transistor Tr2 may be L2, and the gate width thereof may be W2. A relationship of (W1/L1)>(W2/L2) may be established and the initial threshold voltage Vth1_i may be set higher than the initial threshold voltage Vth2_i. The initial threshold voltage Vth1_i and the initial threshold voltage Vth2_i may be adjusted by adjusting the channel concentration of the transistors.

As further illustrated in FIG. 6, the subtracter SUB1 includes an operational amplifier OP1, a resistor element R1, a resistor element R2, a resistor element R3, and a resistor element R4. One end of the resistor element R2 is coupled to the drain terminal of the NMOS transistor Tr2, and the other end of the resistor element R2 is coupled to a non-inverted input terminal of the operational amplifier OP1. One end of the resistor element R4 is coupled to the ground voltage VSS, and the other end of the resistor element R4 is coupled to the non-inverted input terminal of the operational amplifier OP1. One end of the resistor element R1 is coupled to the drain terminal of the NMOS transistor Tr1*a*. One end of the resistor element R3 is coupled to the output terminal of the operational amplifier OP1. The other end of the resistor element R1 and the other end of the resistor element R3 are coupled, and thus the connection point is coupled to the inverted input terminal of the operational amplifier OP1. The subtracter SUB1 subtracts the voltage Vr1 from the voltage Vr2. The subtraction result, the difference voltage ΔVr, is output from the output terminal of the subtracter SUB1.

As further illustrated in FIG. 6, the reference-differential-voltage generator REF1 outputs a reference difference voltage ΔVref. The reference difference voltage ΔVref may be a target voltage value of the difference voltage ΔVr. The difference voltage ΔVr may be controlled so that the difference voltage ΔV has a value within the range of the reference difference voltage ΔVref. The body-bias voltage characteristics of the NMOS transistor Tr1*a* and the NMOS transistor Tr2 may be obtained in advance, and then the value of the reference difference voltage ΔVref may be determined based on the obtained body-bias voltage characteristics. The reference difference voltage ΔVref may be generated in the semiconductor device 10 of FIG. 1, or may be supplied from outside of the semiconductor device 10 of FIG. 1.

As further illustrated in FIG. 6, the difference voltage ΔVr output from the subtracter SUB1 is input into the inverted input terminal of the comparator COMP1*a*. The reference difference voltage ΔVref output from the reference-differential-voltage generator REF1 is input into the non-inverted input terminal of the comparator COMP1*a*. A signal Vc is output from the output terminal of the comparator COMP1*a*.

The configuration of the biasing circuit 1 of FIG. 2 may be applied to the biasing circuit 1*a* of FIG. 6.

Figure 7A:
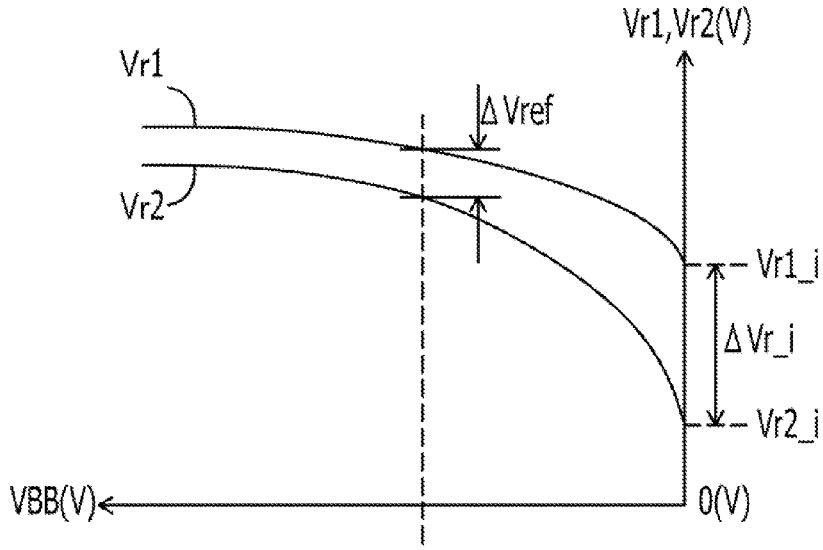
FIGS. 7A and 7B illustrate an exemplary body-bias voltage characteristic.
Figure 7B:
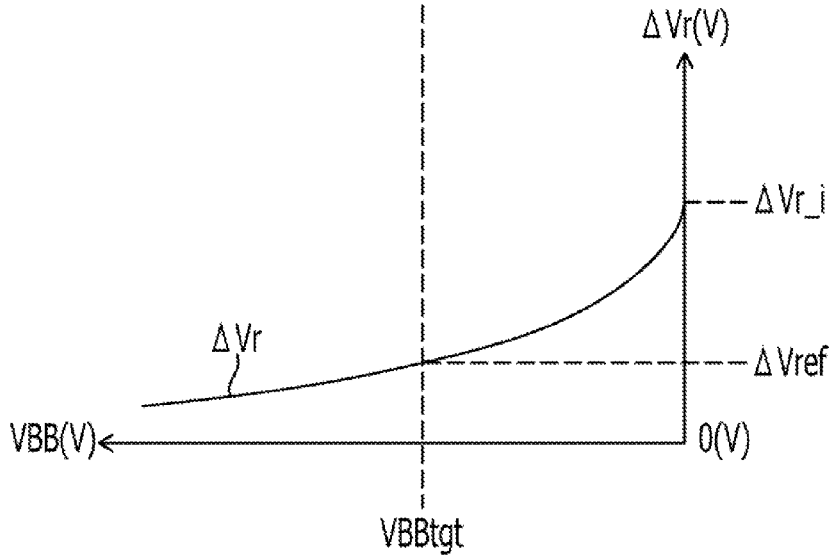

FIGS. 7A and 7B illustrate an exemplary body-bias voltage characteristic. The body-bias voltage characteristic may be the body-bias voltage characteristic of the biasing circuit 1*a* of FIG. 6. When In the state in which the body-bias voltage VBB may be 0 (V), the voltage output from the drain terminal of the NMOS transistor Tr1*a* may be defined as an initial voltage Vr1_i, and the voltage output from the drain terminal of the NMOS transistor Tr2 may be defined as an initial value Vr2_i. In the biasing circuit 1*a* of FIG. 6, the initial threshold voltage Vth1_i of the NMOS transistor Tr1*a* may be higher than the initial threshold voltage Vth2_i of the transistor Tr2, and thus the initial voltage Vr1_i may be higher than the initial voltage Vr2_i. When the body-bias voltage VBB drops to a negative value, the threshold voltages Vth1 and Vth2 may be raised by body-bias effect, and thus the voltages Vr1 and Vr2 also may be raised.

As illustrated in FIGS. 7A and 7B, there are upper limit values of the threshold voltages Vth1 and Vth2, and thus there are upper limit values of the voltages Vr1 and Vr2. The initial voltage Vr1_i of the voltage Vr1 may be higher than the initial voltage Vr2_i of the voltage Vr2. Thus, when the body-bias voltage VBB drops, the voltage Vr1 may increase faster and may be saturated faster than the voltage Vr2. The gradient of the increase in the voltage Vr1 may be smaller than the gradient of the increase in the voltage Vr2. The difference voltage ΔVr between the voltages Vr1 and Vr2 may be reduced as the body-bias voltage VBB drops.

As further illustrated in FIGS. 7A and 7B, when the semiconductor device 10 of FIG. 1 starts operation and the biasing circuit 1*a* of FIG. 6 starts operation, the body-bias voltage VBB may be 0 (V). The value of the difference voltage ΔVr may be an initial difference voltage ΔVr_i. The initial difference voltage ΔVr_i may be higher than the reference difference voltage ΔVref, and thus the signal Vc of the low level may be output from the comparator COMP1 of FIG. 6, and the control signal Ven of the high level may be output to the body-bias voltage generator BB1.

The control signal Ven having a high level is input into the body-bias voltage generator BBG1 of FIG. 6. Accordingly, in the same manner as the biasing circuit 1 of FIG. 2, the body-bias voltage generator BBG1 of FIG. 6 starts operation, and the body-bias voltage VBB may gradually decrease to a negative value. When the body-bias voltage VBB drops, the threshold voltage Vth1 and the threshold voltage Vth2 may be raised by body-bias effect, and thus the voltages Vr1 and Vr2 may be raised. When the voltages Vr1 and Vr2 increase, the difference voltage ΔVr may become small in accordance with the above-described body-bias voltage characteristic.

When the difference voltage ΔVr becomes smaller than the reference difference voltage ΔVref, the output voltage of the comparator COMP1 of FIG. 6 may change to a high-level voltage, and the control signal Ven changes to a low level. The value of the body-bias voltage VBB when the difference voltage ΔVr becomes substantially equal to the reference difference voltage ΔVref may be defined as a target body-bias voltage VBBtgt. When the control signal Ven having a low level is input into the body-bias voltage generator BBG1 of FIG. 6, the body-bias voltage generator BBG1 of FIG. 6 may stop operation. When the body-bias voltage generator BBG1 of FIG. 6 stops operation, the body-bias voltage VBB gradually may increase, and thus the voltages Vr1 and Vr2 drop, and the difference voltage ΔVr may become large.

When the difference voltage ΔVr becomes smaller than the reference difference voltage ΔVref, the body-bias voltage generator BBG1 of FIG. 6 may stop operation. When the difference voltage ΔVr becomes larger than the reference difference voltage ΔVref, the body-bias voltage generator BBG1 of FIG. 6 may start operation. The body-bias voltage generator BBG1 of FIG. 6 is thus controlled. As further illustrated in FIGS. 7A and 7B, the body-bias voltage generator BBG1 of FIG. 6 is controlled to repeat stopping and starting operations so that the difference voltage ΔVr falls within the reference difference voltage ΔVref. The value of body-bias voltage VBB output from the body-bias voltage generator BBG1 of FIG. 6 may be maintained as an average value to be the value of the target body-bias voltage VBBtgt.

By the controller 2*a* of FIG. 6, the body-bias voltage VBB is generated based on the control signal Ven such that the difference voltage ΔVr between the threshold voltage Vth1 and the threshold voltage Vth2 falls within the range of the reference difference voltage ΔVref. The body-bias voltage VBB generated by the body-bias voltage generator BBG1 of FIG. 6 is supplied to the device circuit DC1 of FIG. 1. In the device circuit DC1 of FIG. 1, the body-bias voltage VBB is supplied to the backgate terminal of the transistor to which a high threshold voltage is set and the backgate terminal of the transistor to which a low threshold voltage is set. Variations in threshold voltage of transistors in the device circuit DC1 of FIG. 1 may be reduced.

According to the biasing circuit 1*a* of FIG. 6, the difference voltage ΔVr between the threshold voltage Vth1 of the NMOS transistor Tr1*a* and the threshold voltage Vth2 of the NMOS transistor Tr2 may be detected. The body-bias voltage VBB may be adjusted so that the difference voltage ΔVr falls within the reference difference voltage ΔVref. The biasing circuit 1*a* includes a feedback loop to adjust the threshold voltage Vth2 of the NMOS transistor Tr2. The feedback loop may be used to control and reduce variations in the threshold voltage of transistors.

Figure 8:
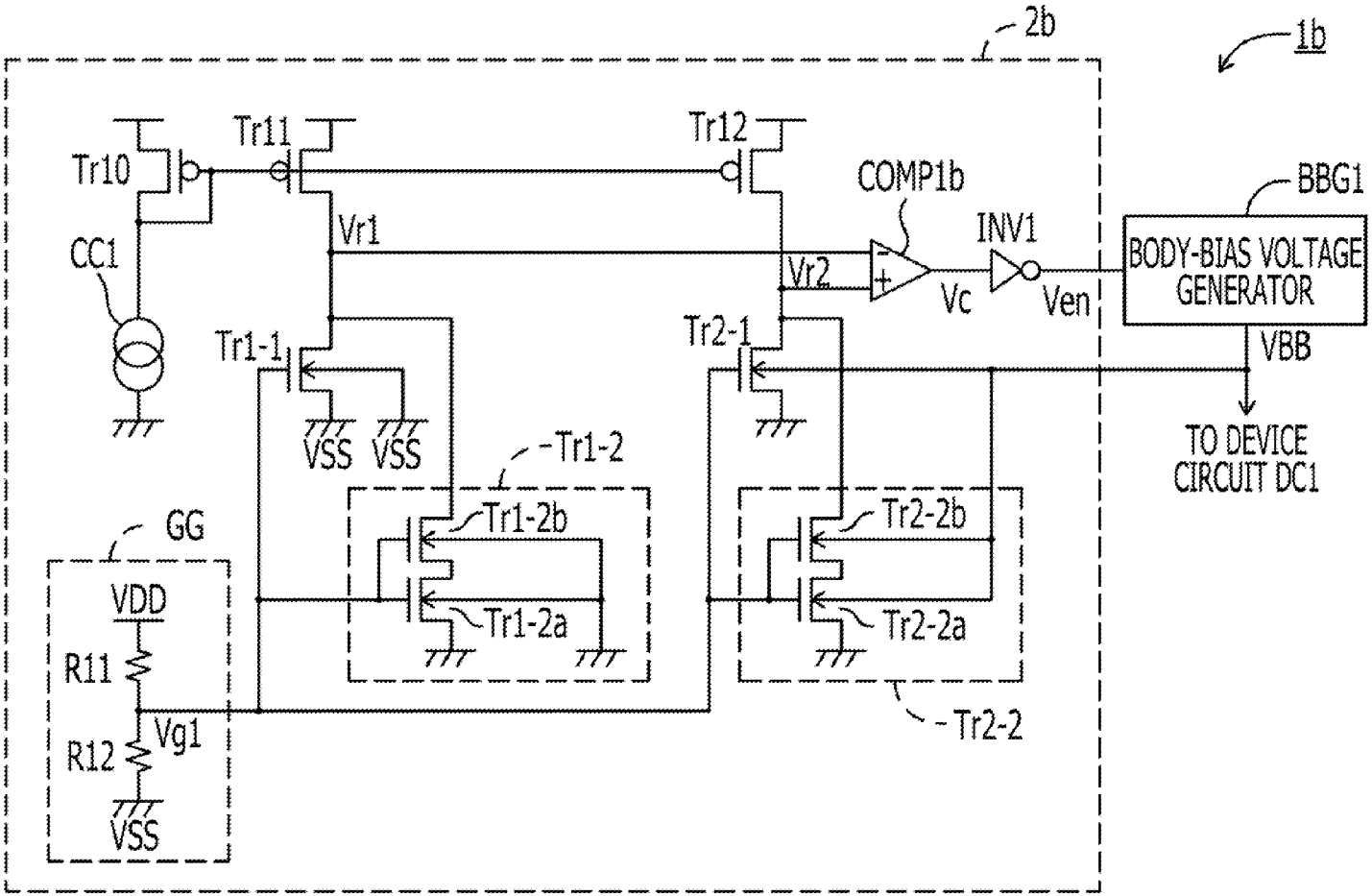
FIG. 8 illustrates an exemplary biasing circuit.

FIG. 8 illustrates an exemplary biasing circuit. The biasing circuit 1*b* illustrated in FIG.8 may be applied to the semiconductor device 10 of FIG. 1. The biasing circuit 1*b* includes a controller 2*b*, and a body-bias voltage generator BBG1. The controller 2*b* includes an NMOS transistor Tr1-1, an NMOS transistor Tr2-1, an NMOS transistor group Tr1-2, an NMOS transistor group Tr2-2, a gate-voltage generation circuit GG, a comparator COMP1*b*, an inverter INV1, a constant current circuit CC1, a PMOS transistor Tr10, a PMOS transistor Tr11, and a PMOS transistor Tr12.

As illustrated in FIG. 8, the NMOS transistor Tr1-1 and the NMOS transistor group Tr1-2 may be replica transistors. The ground voltage VSS is supplied to the source terminal and the backgate terminal of the NMOS transistor Tr1-1. The NMOS transistor group Tr1-2 includes an NMOS transistor Tr1-2*a* and an NMOS transistor Tr1-2*b*, which are coupled in series with each other. The ground voltage VSS is supplied to the source terminal of the NMOS transistor Tr1-2*a*. The ground voltage VSS is supplied to the backgate terminal of the NMOS transistor Tr1-2*a* and the backgate terminal of the NMOS transistor Tr1-2*b*. The drain terminal of the NMOS transistor Tr1-1 and the drain terminal of the NMOS transistor Tr1-2*b* are coupled and the connection point thereof is coupled to the drain terminal of the PMOS transistor Tr11.

A ratio of a number of transistors, which may be a ratio of a number of transistors included in the NMOS transistor Tr1-1 of FIG. 8 to a number of transistors included in the transistor group Tr1-2 of FIG. 8, may be determined in accordance with the distribution ratio of the transistors included in the device circuits DC1 to DC4 of FIG. 1, to which the body-bias voltage VBB is supplied. The distribution ratio of the transistors may include an average value of the ratios of a number of single transistors, for example, inverters, to series-coupled transistors, for example, NAND cells, etc. The distribution ratio of the transistors may be calculated using logical design data. The biasing circuit 1*b* of FIG. 8 may have the ratio of the numbers of the transistors is 1:2.

The NMOS transistor Tr2-1 of FIG. 8 and the NMOS transistor group Tr2-2 of FIG. 8 may be replica transistors. The NMOS transistor group Tr2-2 includes an NMOS transistor Tr2-2*a* and an NMOS transistor Tr2-2*b*, which are coupled in series with each other. The body-bias voltage VBB is supplied to the backgate terminal of the NMOS transistor Tr2-2*a*, and the backgate terminal of the NMOS transistor Tr2-2*b*. The other configurations of the NMOS transistor Tr2-1 and the NMOS transistor group Tr2-2 may be substantially the same as or similar to those of the above-described NMOS transistor Tr1-1 and the NMOS transistor group Tr1-2. The ratio of the number of transistors may be substantially the same as or similar to that of the above-described NMOS transistor Tr1-1 and the NMOS transistor group Tr1-2.

As further illustrated in FIG. 8, the gate-voltage generation circuit GG includes a resistor element R11 and a resistor element R12, which are coupled in series between the power-source voltage VDD and the ground voltage VSS. A gate voltage Vg1 is output from the connection point between the resistor element R11 and the resistor element R12. The gate voltage Vg1 is input into the gate terminal of the NMOS transistor Tr1-1, the gate terminal of the NMOS transistor Tr2-1, the gate terminal of the NMOS transistor group Tr1-2, and the gate terminal of the NMOS transistor group Tr2-2. The gate voltage Vg1 may be determined based on the voltage divided by the resistor element R11 and the resistor element R12, and thus the value of the gate voltage Vg1 may be changed by changing the ratio of the resistance value of the resistor element R11 to the resistance value of the resistor element R12. For example, if the resistance value of the resistor element R11 is substantially equal to the resistance value of the resistor element R12, a gate voltage Vg1 having a voltage value half the power-source voltage VDD may be generated.

The configuration of the biasing circuit 1 of FIG. 2 may be applied to the biasing circuit 1*b* of FIG. 8.

As further illustrated in FIG. 8, the biasing circuit 1*b* includes as replica transistors the NMOS transistor Tr1-1, the NMOS transistor Tr2-1, the NMOS transistor group Tr1-2, and the NMOS transistor group Tr2-2. The biasing circuit 1*b* may include a circuit configuration more suitable for actual use than a biasing circuit using single transistors. In the biasing circuit 1*b*, the gate voltage Vg1 generated by the gate-voltage generation circuit GG is input into the gate terminals of the individual replica transistors. The biasing circuit 1*b* may generate a state in which replica transistors are used, and thus may include a circuit configuration more suitable for actual use. The configuration of the replica transistors may come close to the actual use, thereby the body-bias voltage VBB being controlled with high accuracy.

Figure 9:
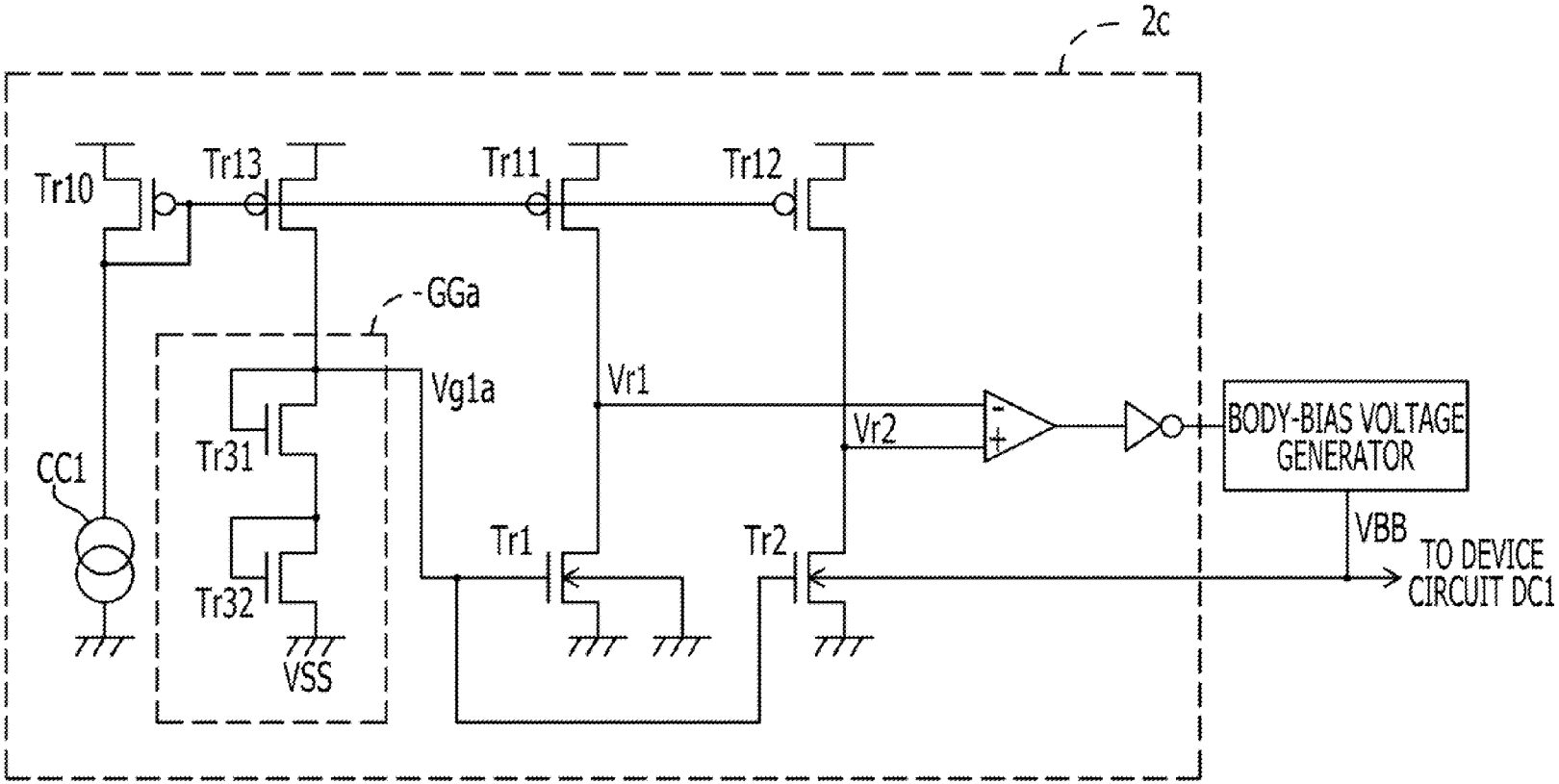
FIG. 9 illustrates an exemplary controller.

FIG. 9 illustrates an exemplary controller. The controller 2*c* illustrated in FIG. 9 may be applied to the semiconductor device 10 of FIG. 1. The controller 2*c* includes a gate-voltage generation circuit GGa. The gate-voltage generation circuit GGa includes an NMOS transistor Tr31 and an NMOS transistor Tr32, which are coupled in series between the drain terminal of a PMOS transistor Tr13 and the ground voltage VSS. The gate terminal and the drain terminal of the NMOS transistor Tr31 are diode-coupled. The gate terminal and the drain terminal of the NMOS transistor Tr32 are diode-coupled. A gate voltage Vg1*a* is output from the drain terminal of the NMOS transistor Tr31. The gate voltage Vg1*a* is input into the gate terminal of the NMOS transistor Tr1 and the gate terminal of the NMOS transistor Tr2. The configuration of the controller 2 in the biasing circuit 1 of FIG. 2 may be applied to the configuration of the controller 2C illustrated in FIG. 9.

The gate voltage Vg1*a* generated by the gate-voltage generation circuit GGa of FIG. 9 is input into the gate terminal of the NMOS transistor Tr1 and the gate terminal of the NMOS transistor Tr2, thereby generating a state where the NMOS transistor Tr1 and the NMOS transistor Tr2, which are replica transistors, operate. When the gate-voltage generation circuit GGa of FIG. 9 is used, the circuit configuration becomes more suitable for actual use. Since the gate voltage is generated by diode-coupled transistors, less current may be consumed as compared with a case where the gate voltage is generated by a divided resistance voltage.

Figure 10:
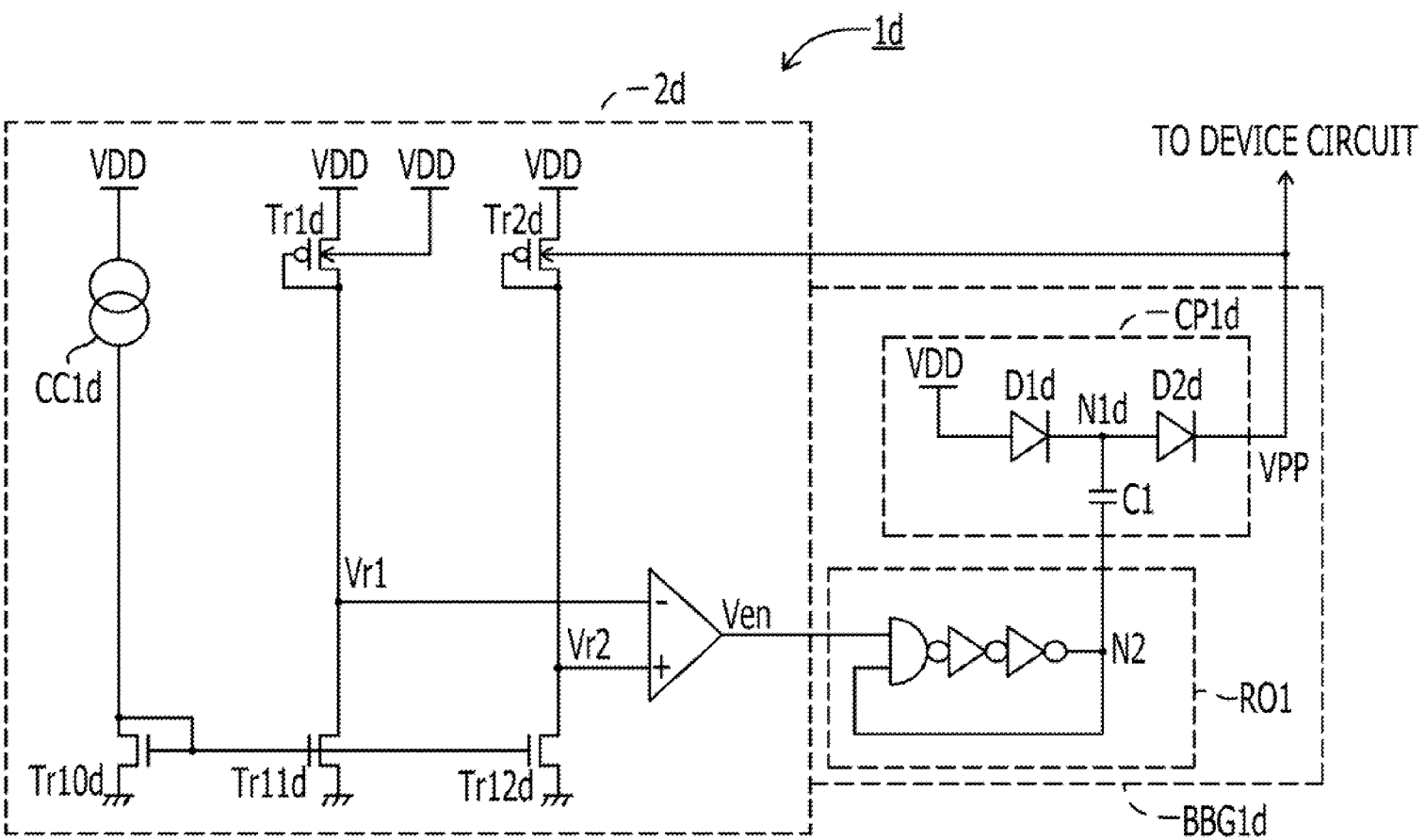
FIG. 10 illustrates an exemplary biasing circuit.

FIG. 10 illustrates an exemplary biasing circuit. The biasing circuit 1*d* illustrated in FIG. 10 may be applied to the semiconductor device 10 of FIG. 1. As illustrated in the biasing circuit 1*d*, the body-bias voltage of a PMOS transistor may be controlled. The biasing circuit 1*d* includes a controller 2d and a body-bias voltage generator BBG1*d*. The power-source voltage VDD is supplied to the source terminal and the backgate terminal of a PMOS transistor Tr1*d*. The gate terminal and the drain terminal of the PMOS transistor Tr1*d* are diode-coupled. The power-source voltage VDD is supplied to the source terminal of the PMOS transistor Tr2*d*. The body-bias voltage VPP is supplied to the backgate terminal of a PMOS transistor Tr2*d*. The gate terminal and the drain terminal of the PMOS transistor Tr2*d* are diode-coupled. The threshold voltage Vth2*d* of the PMOS transistor Tr2*d* may be increased by body-bias effect obtained by controlling the body-bias voltage VPP.

As illustrated in FIG. 10, the body-bias voltage generator BBG1*d* includes a ring oscillator R01, and a charge pump CP1*d*. The charge pump CP1*d* includes a capacitor C1, a diode D1*d*, and a diode D2*d*. The power-source voltage VDD is input into the anode of the diode D1*d*. The cathode of the diode D1*d* and the anode of the diode D2*d* are coupled to a node (pumping node) N1*d*. One end of the capacitor C1 is coupled to the node N1*d*, and the other end of the capacitor C1 is coupled to the node N2, for example, output terminal of the ring oscillator RO1. The body-bias voltage VPP is output from the cathode of the diode D2*d*. The configuration of the biasing circuit 1 of FIG. 2 may be applied to the biasing circuit 1*d* illustrated in FIG. 10.

As further illustrated in FIG. 10, the control signal Ven having a high level is input into the body-bias voltage generator BBG1*d*, and in the same manner as the biasing circuit 1 of FIG. 2, the body-bias voltage generator BBG1*d* starts operation. The body-bias voltage VPP may gradually increase to a value higher than the power-source voltage VDD. When the body-bias voltage VPP increases, in the PMOS transistor Tr2*d*, the gate-to-backgate voltage may become higher than the gate-to-source voltage. By body-bias effect, the threshold voltage Vth2*d* of the PMOS transistor Tr2*d* may be raised in accordance with the increase of the body-bias voltage VPP.

One controller may control both the body-bias voltage VBB of the NMOS transistor and the body-bias voltage VPP of the PMOS transistor. Thus, the variations in the threshold voltage of transistors may be reduced with a more accurate control.

In the biasing circuit 1 of FIG. 2, the drain terminal of the NMOS transistor Tr1 of FIG. 2 is coupled to the inverted input terminal of the comparator COMP1 of FIG. 2, and the drain terminal of the NMOS transistor Tr2 of FIG. 2 is coupled to the non-inverted input terminal of the comparator COMP1 of FIG. 2. In the biasing circuit 1*a* of FIG. 6, the output terminal of the subtracter SUB1 of FIG. 6 is coupled to the inverted input terminal of the comparator COMP1*a* of FIG. 6, and the output terminal of the reference-differential-voltage generator REF1 of FIG. 6 is coupled to the non-inverted input terminal of the comparator COMP1*a* of FIG. 6. The polarity of the input terminal of the comparator COMP1 of FIG. 2 and the polarity of the input terminal of the comparator COMP1*a* of FIG. 6 are not limited to the above-described embodiments. The polarity of the input terminal of the comparator COMP1 of FIG. 2 and the polarity of the input terminal of the comparator COMP1*a* of FIG. 6 may be selected optionally, for example, in accordance with the relationship between the threshold voltage Vth1 and the voltage Vr1, the relationship between the threshold voltage Vth2 and the voltage Vr2, and whether the inverter INV1 is provided or not.

The biasing circuit 1 of FIG. 2 is not limited to the configuration in which the body-bias voltage VBB is supplied to the backgate terminal of the NMOS transistor Tr2 of FIG. 2, and the ground voltage VSS is supplied to the backgate terminal of the NMOS transistor Tr1 of FIG. 2. The body-bias voltage VBB may be supplied to the backgate terminal of the NMOS transistor Tr1 of FIG. 2. With the body-bias voltage characteristic of FIG. 7, the difference voltage ΔVr between the voltage Vr1 and the voltage Vr2 becomes small, and the threshold voltage Vth2 may come close to the threshold voltage Vth1.

In the controller 2*a* of FIG. 6, an amplifier, which multiplies the difference voltage ΔVr by k times and outputs the resultant voltage, may be coupled between the subtracter SUB1 of FIG. 6 and the comparator COMP1*a* of FIG. 6. The value of the reference difference voltage ΔVref is set so that the reference difference voltage ΔVref is ΔVr×k.

Example embodiments of the invention have now been described in accordance with the above advantages. It will be appreciated that these examples are merely illustrative of the invention. Many variations and modifications will be apparent to those skilled in the art.

The invention claimed is:

1. A body-bias voltage controller comprising:

a plurality of transistors, at least one of which being supplied with a body-bias voltage;

a monitor circuit to detect voltage characteristics of the plurality of transistors and to output an indicator signal; and a body-bias voltage generator to generate the body-bias voltage based upon the indicator signal;

wherein the voltage characteristics detected by the monitor circuit include a difference between voltage characteristics of at least two transistors of the plurality of transistors, and the body-bias voltage generator is operable to reduce the difference;

wherein the voltage characteristics of the at least two transistors include threshold voltages, and the at least two transistors include a first transistor and a second transistor whose backgate terminals are supplied with the body-bias voltage;

wherein the monitor circuit includes, a subtracter arranged to output a difference voltage between the threshold voltage of the first transistor and the threshold voltage of the second transistor;

a reference-voltage setting section arranged to output a reference voltage for difference voltage; and a first comparator arranged to output a first comparison signal in accordance with a difference between the difference voltage and the reference voltage; and wherein the body-bias voltage generator is operable to adjust the body-bias voltage based on the first comparison signal such that the difference voltage is within a range corresponding to the reference voltage.

2. The body-bias voltage controller according to claim 1, wherein the body-bias voltage generator adjusts the body-bias voltage such that a voltage between a gate and a backgate is higher than a voltage between a gate and a source when the difference voltage is out of the range of the reference voltage, and the body-bias voltage generator adjusts the body-bias voltage such that the gate-to-backgate voltage is lower than the gate-to-source voltage when the difference voltage is within the range of the reference voltage.

3. The body-bias voltage controller according to claim 1, wherein a value obtained by a gate width of the first transistor being divided by a gate length of the first transistor is greater than a value obtained by a gate width of the second transistor being divided by a gate length of the second transistor.

4. The body-bias voltage controller according to claim 1, wherein a value obtained by a gate width of the first transistor being divided by a gate length of the first transistor is greater than a value obtained by a gate width of the second transistor being divided by a gate length of the second transistor.

5. The body-bias voltage controller according to claim 1, wherein a voltage value applied to a gate terminal of the first transistor is substantially equal to a voltage value applied to a gate terminal of the second transistor.

6. The body-bias voltage controller according to claim 1, wherein a voltage value applied to a gate terminal of the first transistor is substantially equal to a voltage value applied to a gate terminal of the second transistor.

7. The body-bias voltage controller according to claim 1, wherein each of the plurality of transistors is diode-coupled.

8. The body-bias voltage controller according to claim 1, wherein the body-bias voltage controller includes a ring oscillator which oscillates based on the indicator signal.

9. A body-bias voltage controller comprising:

a plurality of transistors, at least one of which being supplied with a body-bias voltage;

a monitor circuit to detect voltage characteristics of the plurality of transistors and to output an indicator signal;

a body-bias voltage generator to generate the body-bias voltage based upon the indicator signal;

a current supply section to supply a current; and two multiple-stage transistor groups which correspond, respectively, to at least two transistors of the plurality of transistors, each multiple-stage group including a plurality of transistors coupled in series, wherein drain terminals of the at least two transistors are coupled to the current supply section, drain terminals positioned at end parts of the two multiple-stage transistor groups are coupled to the current supply section, and the monitor circuit monitors a voltage of a connection point of the at least two transistors, the two multiple-stage transistor groups, and the current supply section.

10. A method for controlling a body-bias voltage, the method comprising:

detecting, by a monitor circuit, voltage characteristics of a plurality of transistors respectively supplied with a body-bias voltage that is generated by a body-bias voltage generator based upon an indicator signal output from the monitor circuit; and controlling the body-bias voltage of at least one of the plurality of transistors so that a difference in the voltage characteristics between at least two transistors of the plurality of transistors is reduced, wherein the detected voltage characteristics include a difference between voltage characteristics of the at least two transistors, and the body-bias voltage generator is operable to reduce the difference;

wherein the voltage characteristics of the at least two transistors includes threshold voltages, and the at least two transistors includes a first transistor and a second transistor whose backgate terminals are supplied with the body-bias voltage, wherein the monitor circuit includes:

a subtracter arranged to output a difference voltage between the threshold voltage of the first transistor and the threshold voltage of the second transistor;

a reference-voltage setting section arranged to output a reference voltage for difference voltage; and a first comparator arranged to output a first comparison signal in accordance with a difference between the difference voltage and the reference voltage; and wherein the body-bias voltage generator is operable to adjust the body-bias voltage based on the first comparison signal such that the difference voltage is within a range corresponding to the reference voltage.

11. The method according to claim 10, wherein:

the detecting includes determining a difference between voltage characteristics of at least two of the transistors; and the generating includes adjusting the body-bias voltage so as to reduce the difference based upon the indicator signal.

* * * * *